US007293434B2

(12) United States Patent
Ikeguchi et al.

(10) Patent No.: US 7,293,434 B2
(45) Date of Patent: Nov. 13, 2007

(54) KNITTED/WOVEN CONCEALED TYPE SLIDE FASTENER

(75) Inventors: Yoshito Ikeguchi, Toyama-ken (JP); Norio Uozumi, Toyama-ken (JP); Yoshio Matsuda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 21 days.

(21) Appl. No.: 10/559,096

(22) PCT Filed: Jun. 2, 2003

(86) PCT No.: PCT/JP03/06954

§ 371 (c)(1),
(2), (4) Date: Dec. 1, 2005

(87) PCT Pub. No.: WO2004/107902

PCT Pub. Date: Dec. 16, 2004

(65) Prior Publication Data

US 2007/0089466 A1 Apr. 26, 2007

(51) Int. Cl.
*D04B 23/13* (2006.01)

(52) U.S. Cl. ..... 66/193; 66/195

(58) Field of Classification Search ..... 66/190, 66/192, 193, 195; 24/292
See application file for complete search history.

(56) References Cited

U.S. PATENT DOCUMENTS 4,015,449 A 4/1977 Matsuda et al.
5,035,267 A 7/1991 Shimono
5,540,064 A 7/1996 Matsuda et al.
5,832,961 A 11/1998 Shimono
5,857,359 A * 1/1999 Matsuda et al. ..... 66/193
6,006,552 A * 12/1999 Matsuda et al. ..... 66/193
6,651,296 B2 * 11/2003 Matsuda ..... 24/397
6,886,368 B2 * 5/2005 Matsuda ..... 66/192
6,971,253 B2 * 12/2005 Matsuda et al. ..... 66/193

FOREIGN PATENT DOCUMENTS

JP 46-7018 2/1971
JP 57-37308 2/1982

(Continued)

*Primary Examiner*—Danny Worrell
(74) *Attorney, Agent, or Firm*—Everest Intellectual Property Law Group; Michael S. Leonard

(57) ABSTRACT

A multifilament yarn composed of multiple filaments as thin as 0.5 to 1.5 dTex is used for all warp knitting yarns (1, 2) and warp weaving yarns (21 to 35-N) of a tape main body (A). As for an exposed portion on a side of a coupling head of each element covered with multiple fixing yarns (11, 11), when it is assumed that a distance from a front end of each coupling head (Eh) to an inside face of a connecting portion (Ec) is (a) while a dimension of a covered portion of an element (E) covered with the fixing yarns (11, 11) in a direction of a leg portion (El) thereof is (b), a value of a ratio (b/a) is larger than 1/2 and 4/5 or less. As a consequence, it is possible to obtain a knitted/woven concealed type slide fastener in which fastener elements are attached strongly in a stable manner, and even if a strong lateral force is applied to the slide fastener during usage, a coupling portion of a fastener element row is difficult to be seen from outside, the knitted/woven concealed type slide fastener being thin and plastic.

14 Claims, 6 Drawing Sheets

FOREIGN PATENT DOCUMENTS

| | | |
|---|---|---|
| JP | 2-132419 | 11/1990 |
| JP | 2-283306 | 11/1990 |
| JP | 8-228813 | 9/1996 |
| JP | 9-234103 | 9/1997 |
| JP | 11-187909 | 7/1999 |

* cited by examiner

KNITTED/WOVEN CONCEALED TYPE SLIDE FASTENER

TECHNICAL FIELD

The present invention relates to a knitted/woven concealed type slide fastener in which a continuous fastener element row made of synthetic resin monofilament is knitted or woven successively, at the same time when the fastener tape is knitted or woven, into a fastener element attaching portion of a knitted/woven fastener tape composed of a knitting structure or weaving structure having a fastener element attaching portion and a tape main body, such that respective coupling heads are directed toward the fastener tape main body. More particularly, the present invention relates to a knitted/woven concealed type slide fastener in which elements are knitted or woven in at the same time when its fastener tape is knitted or woven, the element coupling portion is not seen from outside even if the concealed type slide fastener is composed of a fastener tape having plasticity, and no disengagement is induced when a strong bending force or upward pushing force is applied to the fastener.

BACKGROUND ART

A concealed type slide fastener includes a type in which fastener elements are attached on a fastener element attaching portion formed on a side edge portion of a fastener tape created by knitting or weaving in advance, by sewing or molding, and a type in which at the same time when a fastener tape is knitted or woven, a continuous fastener element row composed of synthetic resin monofilament is fixed on a fastener element attaching portion by knitting or weaving.

For example, in case of the knitted concealed type slide fastener, at the time when a warp knitted tape having a fastener element attaching portion and a tape main body is formed by knitting, monofilaments made of synthetic resin in which coupling heads are molded in advance by stamping processing are warp-inserted continuously such that its upper/lower leg portions are arranged neatly in line, so that the continuous element row is knitted into the fastener tape.

In case of an ordinary knitted slide fastener, a continuous fastener element row is knitted in such that respective coupling heads are projected outward from an outside end of a fastener element attaching portion while each connecting portion for connecting upper/lower leg portions is disposed on a boundary portion on a tape main body. However, in case of the concealed type slide fastener, as disclosed in for example, Japanese Patent Application Laid-Open (JP-A) No. 8-228813, coupling heads of fastener elements are disposed along a bending region which is a boundary portion between a tape main body and a fastener element attaching portion, and a connecting portion is disposed along the outside end of the fastener element attaching portion.

A concealed type slide fastener stringer obtained by such knitting is folded along the bending region such that the fastener element row is exposed to the outside and set up, and the folded condition is fixed. With fastener elements of right and left stringers whose folding condition is fixed, meshed with each other, a fastener chain is produced. After a slider for the concealed type slide fastener is attached on the fastener chain, it is cut to a predetermined length and top and bottom end stops are attached, thereby finally producing a concealed type slide fastener which is a final product. Because the concealed type slide fastener is sewed on clothes with its fastener element row set inside, the fastener element row is not seen from outside.

According to FIGS. 24 and 25 in the JP-A No. 8-228813 (patent document 1) and corresponding description thereof, the upper leg portion and the lower leg portion are arranged neatly in their vertical relation by reciprocating monofilament which forms a coil-like fastener element row within the same course. In addition, with the coupling heads disposed near the inside end of the fastener element attaching portion and the connecting portion disposed near the outside end of the fastener tape, the upper/lower leg portions are pressed with three fixing chain yarns 10 which knit with a double structure by weft-insertion and at the same time when the fastener tape is knitted, the coil-like fastener element row is fixed on the fastener element attaching portion.

On the other hand, the woven concealed type slide fastener has been disclosed in, for example, Japanese Utility Model Application Laid-Open No. 2-132419 (patent document 2), JP-A No. 2-283306 (patent document 3), JP-A No. 9-234103 (patent document 4) and the like. In any case, at the same time when a fastener tape having a weaving structure is formed by knitting, a monofilament made of synthetic resin whose coupling heads are molded in advance is woven continuously into the fastener element attaching portion of the fastener tape.

Meanwhile, different from a type in which fastener elements are fixed on the element attaching portion of the fastener tape by sewing, caulking or molding the fastener elements, usually, the above-described knitted/woven concealed type slide fastener often contains no core thread at the element attaching portion of the fastener tape. This core thread is knitted or woven by being inserted in the warp direction from the side edge of the element attaching portion when the fastener tape is knitted or woven. By sandwiching the core thread knitted or woven in this way between the upper and lower leg portions under a pressure, the respective elements are fixed firmly on the fastener tape, so as to keep the fastener elements from slipping out of the fastener tape.

In case of the knitted/woven concealed type slide fastener, if it is intended to knit or weave the core thread into the fastener tape, a special mechanism for knitting or weaving the core thread is necessary as disclosed in the above-described patent document 4, thereby complicating the structure of a knitting machine or weaving machine. The knitted/woven concealed type slide fastener of this type has been originally developed to intensify fashion performance without deteriorating its appearance of an outer garment or the like, and in recent years, has been often employed by thin clothes having ample plasticity. In order to sew the knitted/woven concealed type slide fastener on this kind of thin clothes, it is desirable to form the fastener tape itself into a thin and plastic structure and at the same time, eliminate gaps between the upper and lower leg portions of the fastener element itself, so that the upper and lower leg portions are fitted to each other if possible so as to reduce the entire thickness of the concealed type slide-fastener. However, existence of the core thread is opposite to these demands.

Further, if the core thread is eliminated, it comes that the fastener elements are only fixed with an element fixing (tightening) warp knitting yarn or warp weaving yarn disposed at the element attaching portion. As a consequence, as described above, the attaching position of the fastener elements changes on the fastener tape, so that the position of the coupling head becomes likely to deflect in the tape width direction of the fastener tape. Thus, the arrangement position of the coupling heads likely becomes uneven. This is fatal for the concealed type slide fastener whose purpose is to inhibit the coupling state of the coupling heads from being seen from outside of an attaching object when the slide fastener is closed.

On the other hand, when this kind of concealed type slide fastener is sewed on an attaching object, in case of the knitted concealed type slide fastener, it is sewed along a bending portion of each fastener element row of its right/left stringers, that is, a groove formed between two wales adjacent to the coupling head of each fastener element row. In case of the woven concealed type slide fastener, it is sewed to an attaching object along the bending portion of each fastener element row of the right/left stringers, that is, along multiple warp yarns adjacent to the coupling head of each fastener element row.

When the slide fastener is closed in case of an attaching object on which stringers of right and left slide fasteners are attached with a sewing thread, if right and left attaching objects are pulled strongly in a departing direction, loops of the sewing thread are pulled together with the attaching object. As a consequence, the loop positions of right and left sewing threads deflect across a groove stretching in the wale direction of the right and left stringers of the sewed slide fastener or in the departing direction of the weft yarns located between warp yarns at a sewing position, so that a gap is generated between the right and left attaching objects and the stringers, thereby often the coupling heads of the fastener elements being seen from outside.

The present invention has been accomplished to solve the above-described problem, and a specific object of the invention is to provide a knitted or woven concealed type slide fastener in which continuous fastener elements are knitted or woven at the same time when a fastener tape is knitted or woven, wherein coupling portions of fastener element rows are not seen through between attaching objects from outside when the slide fastener is closed, and more particularly to a concealed type slide fastener having ample function as a concealed type slide fastener capable of securing a required mounting strength to the fastener element row even in a thin and highly plastic fastener tape.

DISCLOSURE OF THE INVENTION

Although how a fastener tape itself is formed thinly with plasticity depends on partly material of its constituent yarns, generally, it depends largely on the thickness and structure of the constituent yarns, a knitting structure or weaving structure, and mesh size or weaving density of the fastener tape. Further, even if these factors are selected appropriately, it is not guaranteed that a required mounting strength of the fastener element can be obtained. If it is intended to acquire a sufficient mounting strength of the fastener elements, it is necessary to increase a tightening force to the fastener elements by warp knitting yarns or warp weaving yarns for fixing the elements to be knitted or woven into the fastener element attaching portion of a fastener tape composed of a knitting structure or weaving structure.

Particularly, to acquire a thin, plastic structure and fastener element mounting strength for the knitted/woven concealed type slide fastener of the present invention, the warp knitting yarn or warp weaving yarn for fixing the element for use therein needs to be thickened to some extent within a allowable range. Generally, the reason why the slide fastener is formed thinly and plastically is, as already described, that when an attaching object itself on which the slide fastener is to be attached is plastic and thin, the slide fastener needs to be fitted well to the attaching object at the time when and after it is sewed on. Thus, the plasticity demanded for the slide fastener is demanded for particularly the tape main body in the fastener tape. Of course, the fastener element attaching portion itself is desired to be plastic. However, because fastener elements having some extent of rigidity exist there and these fastener elements need to be coupled to such an extent that they never disengage easily, the fastener element attaching portion itself only need to satisfy a plasticity in the tolerable range.

In addition to these general requirements, particularly, the knitted/woven concealed type slide fastener need to be so constructed that when a product loaded with the same slide fastener is used, the coupling portion of the slide fastener cannot be seen from outside. However, if fine yarns are used for all constituent yarns of the slide fastener in order to form the slide fastener entirely into a thin and plastic structure, as described above, a required mounting strength cannot be secured easily for the fastener elements and at the same time, the element attaching position on the fastener tape or a bending position of the fastener tape when the attaching object is pulled sideway becomes likely to deflect, so that right and left attaching objects and a sewed portion of the fastener tape are opened to the right and left sides. As a result, a gap occurs between them, thereby the coupling portion of the slide fastener being visible from outside when the product loaded with the slide fastener is used practically.

As a result of accumulated considerations by the inventors paying attention to these points, in case of the knitted/woven concealed type slide fastener containing no core thread, it has been found that even if not so much attention is paid to forming it thinly and plastically, particularly, the degree of covering to the fastener elements with the warp knitting yarns or warp weaving yarns for fixing the fastener elements, the structure and thickness of the fixing warp knitting yarn or warp weaving yarn or a knitting/weaving structure in and knitting/weaving way for the tape bending region on a boundary between the element attaching portion and the tape main body of the fastener tape can be factors which keep the coupling heads from being exposed outside when a product loaded with the slide fastener is used.

The basic structure of the present invention has a feature in the warp knitting yarn for fixing the fastener elements or the degree of covering of the warp weaving yarn. That is, this feature exists in a knitted/woven concealed type slide fastener in which a continuous fastener element row composed of synthetic resin monofilament is knitted or woven into a fastener element attaching portion of a knitted/woven fastener tape constituted of warp knitting structure or weaving structure, the knitted/woven fastener tape comprising a tape main body and a fastener element attaching portion, with each coupling head directed toward the fastener tape main body at the same time when the fastener tape is knitted or woven, the knitted/woven concealed type slide fastener further comprising: multiple fixing yarns which are knitted or woven into the fastener element attaching portion and which fix each element of the continuous fastener element row onto the fastener element attaching portion, and that an exposed portion of each element covered with each fixing yarn of the fastener element row is located on the side of the coupling head, and when it is assumed that a distance from a front end of each coupling head to an inside face of a connecting portion is (a) while the dimension of each element in a direction of a leg portion covered with the fixing yarn is (b), a value of (b/a) is larger than 1/2 and 4/5 or less.

As for the exposed portion of each element covered with each fixing yarn for the fastener element row, when the distance from the front end of each coupling head to the inside face of the connecting portion is (a) while the dimension in the direction of the element in the direction of the leg portion covered with the fixing yarns is (b), the value of (b/a) is set to larger than 1/2 and 4/5 or less. In this case, even if a gap occurs between right and left sewed portions when a lateral pulling force is applied to a product loaded with the concealed type slide fastener, the coupling portions of the fastener elements at the front end are concealed by the fixing yarns, so that they are never exposed outside, because most of the surface of the upper leg portion of each element is covered with respective fixing yarns.

In a product loaded with this kind of knitted/woven concealed type slide fastener, the sewed portion of the slide fastener to the attaching object is a bending portion of the slide fastener or a range in which a groove portion or weft weaving yarn group is stretched, located between the warp knitting yarns (wale) or warp weaving yarn group in the tape main body nearest the fixing yarns in the element attaching portion and the warp knitting yarns (wale) or warp weaving yarn group in the tape main portion adjacent to the same warp knitting yarns or warp weaving yarn group, with the surface at an end portion opposite to the element mounting side of the fastener tape overlapping the front side surface of an end portion of the attaching object.

At this time, at least two fixing yarns are used and the upper/lower leg portions of the fastener element are preferred to be fixed at two or more positions in the length direction. Further, the unit of the fixing yarns can be formed with double yarns in which two ones are arranged in parallel. By using two or more fixing yarns and using double yarns for the same fixing yarn itself, a tightening force onto the fastener element with the fixing yarns can be dispersed widely in the length direction of the upper/lower leg portions, so that the tightening is stabilized and solidified. In the meantime, if the exposed portion of the surface of the upper leg portion of each element covered with each fixing yarn is less than 1/5 an area from the front end of each coupling head to the front end of the connecting portion, the fixing yarn interferes with a slider to disturb the sliding operation of the slider and a smooth coupling between the coupling heads, which is not preferable.

According to the present invention, the total thickness of two or more fixing yarns for covering the surface of the upper leg portion of each element is preferred to be 1.5 to 5 times the other constituent yarns of the fastener tape. As described above, the plasticity demanded for the entire slide fastener is determined by the tape main body, and the plasticity of the element attaching portion on which the fastener elements are to be attached can be sacrificed to some extent in order to secure the engagement strength of the fastener elements. If the thickness of the fixing yarn is set to 1.5 to 5 times the other constituent yarns of the fastener tape, the fixing by the tightening is intensified and deflection of the element diminishes even if there is no core thread. If the thickness is smaller than 1.5 times the other constituent yarns of the fastener tape, the degree of the covering on the fastener elements becomes difficult to obtain. If it exceeds 5 times, the thickness of the tape attaching portion including the fastener element with respect to the tape main body increases too much although the degree of the covering onto the fastener element is obtained. Consequently, not only balance with the attaching object is lost, but also a portion making contact with the human body becomes hard, thereby producing a feeling of disharmony.

As described above, for this kind of concealed type slide fastener, the knitting/weaving structure of the tape bending area which is a boundary portion between the element attaching portion and the tape main body of the fastener tape and its way of usage of the yarns take an important role for keeping the coupling portion of the fastener element row attached on the slide fastener attaching portion from being seen from outside. According to the present invention, preferably, one or more warp yarns at the bending portion in the fastener main body adjacent to the coupling head row of the fastener element row are composed of multifilaments, and the single fiber size of the constituent filament of the yarn is preferably set to 0.5 to 1.5 dTex. The single fiber size of the constituent filament of the warp yarn used at the bending portion of an ordinary concealed type slide fastener is about four times the size of the present invention if the total size of the warp yarns is assumed to be the same, that is, it comes that the quantity of the constituent filaments is about 1/4, and thus, that yarn is relatively a very hard one.

The invention adopts the aforementioned single fiber size, whereby the warp yarn used at the bending portion of the concealed type slide fastener is composed of multiple filaments extremely thin and highly plastic. The warp yarn composed of such multiple filaments is more flexible than conventional one, and therefore, if it is used as the warp yarn at the bending portion, the entire bulk of the bending portion constituted of the same warp yarns increases. Thus, if a lateral force is applied to a product loaded with that concealed type slide fastener and then, a gap occurs between right and left sewed portions, the right and left warp yarn portions at the bending portion never depart from each other, thereby concealing the coupling heads of the slide fastener from outside.

Preferably, the total thickness of the warp yarn at the bending portion in the fastener tape main body adjacent to the coupling head row of the fastener element is set larger than that of the other yarns constituting the foundation structure of the fastener tape. If the total thickness of the warp yarn at the bending portion is set larger than that of the other yarns constituting the foundation structure of the fastener tape, a contact state of the right and left warp yarns at the bending portion is maintained when a gap occurs between right and left sewed portions of a product loaded with the concealed type slide fastener, thereby concealing the coupling portion of the slide fastener from outside securely.

According to the present invention, preferably, at least some weft yarns constituting the element attaching portion of the fastener tape and the tape main body adjacent to the attaching portion has a dry heat shrinking percentage higher by 8 to 20% than other constituent yarns of the fastener tape. The weft yarn constituting the partial foundation structure of the fastener tape possesses a function for tightening the fixing warp yarn of the fastener element disposed in the element attaching portion. In the knitted concealed type slide fastener, the weft yarns used in most of its tape main body are composed of an ordinary yarn having a small dry heat shrinking percentage. However, in the invention, it is preferable to employ the yarns having a high dry heat shrinkage characteristic, composed of multifilaments whose single fiber size is 1.5 to 4.0 dTex as a weft in-laid yarn to be disposed in the element attaching portion and the tape main body along the element attaching portion. Further, in the woven concealed type slide fastener, the yarn having a high dry heat shrinking percentage is used for not only in the element attaching portion but also as part of the weft yarns over the entire width of the fastener tape. With such a structure, the weft yarn (weft in-laid yarn) having the high dry heat shrinking percentage pulls at least the warp yarns for fixing elements disposed in the element attaching portion strongly so as to tighten the same elements firmly.

According to the present invention, depending on a case, all other constituent yarns of the fastener tape except the element fixing warp yarn and weft yarn can be composed of multiple filaments, and the single fiber size of each filament yarn can be set to 0.5 to 1.5 dTex. By adopting such a structure, flexibility and plasticity in the length direction of the fastener tape are secured except the element attaching portion of the slide fastener. Further, depending on a case, the single fiber size of each constituent filament of the weft yarn which is part of the constituent yarns in the tape main body can be set to 0.5 to 1.5 dTex. With such a structure, flexibility and plasticity in the width direction as well as in the length direction of the fastener tape are secured.

Preferably, the fastener tape is constituted of warp knitting structure, and as the fixing warp yarn, the chain knitting yarn, tricot knitting yarn and two needle stitch yarn are employed singly or in combination, and the total thickness of the warp knitting yarns constituting a wale disposed nearest the tape main body is preferred to be set larger than that of the other composition knitting yarns of the foundation structure excluding the fixing warp knitting yarn. Usually, this kind of slide fastener is sewed onto an attaching object along a groove constructed with weft yarns between the warp knitting yarn forming a wale most adjacent to the fixing warp yarn and a wale in the tape main body adjacent to the same wale and at the same time, bent along its sewing line together with the attaching object.

In the concealed type slide fastener obtained in this way, the right and left coupling portions are concealed by right and left wales disposed most adjacent to the tape main body of the fixing warp yarn in conditions in which they are made into a firm contact. If the same wales have a required size, the right and left wales are difficult to depart from each other even if the right and left attaching objects are pulled to the right and left sides, so that the coupling portion cannot be seen easily from outside. As described above, by increasing the thickness of the warp knitting yarn itself for use in the right and left wales, naturally the size of the same wale increases, thereby concealing function of the element coupling portion being exerted effectively. The thickness of the warp knitting yarn for use in the right and left wales means the thickness of the warp knitting yarn constituting the needle loop disposed at the wales.

The knitting yarns constituting a wale formed in the tape main body most adjacent to the fixing warp knitting yarn comprises two or more kinds of warp knitting yarns and two kinds of weft in-laid yarns which are weft-inserted into and folded back to the right and left with respect to a course direction in the wale. At least the weft in-laid yarn in the right and left direction has preferably a dry heat shrinking percentage higher by 8 to 20% than the other composition knitting yarns of the same wale. This groove portion formed between the wale and a wale located in the tape main body adjacent to the same wale is a portion to be sewed onto the attaching object with a sewing thread.

Therefore, when this concealed type slide fastener and the attaching object are sewed together and bent, the right and left wales formed in the tape main body most adjacent to the fixing warp knitting yarn come into a firm contact with each other. If two or more kinds of the warp knitting yarns and two or more kinds of the weft in-laid yarns to be folded back to the right and left sides in the course direction of the same wale are used for this wale, the same wale is enlarged so that elements become difficult to see from outside when the elements are engaged. Further, at the time of dry heat setting, the needle loops of the warp knitting yarns constituting the same wale are tightened from the right and left sides by the weft in-laid yarns as the weft in-laid yarns in the right and left direction forming the same wale is composed of yarns having a dry heat shrinking percentage higher by 8 to 20% than the other composition knitting yarns. Accordingly, the configuration of a groove formed between the adjoining wales in the tape main body becomes evident so as to facilitate the sewing operation at the time of sewing.

Further, according to the invention, preferably, the fixing warp knitting yarn is composed of a chain knitting yarn, and a needle loop thereof strides over the top face of an upper leg portion of the fastener element while a sinker loop thereof is connected to the foundation structure. As a consequence, not only the tightening force to the fastener element increases but also the degree of the covering on the fastener element is intensified, so that the mounting strength of the element increases and the elements become more difficult to see from outside.

Moreover, it is desirable to use two kinds of the knitting yarns, tricot knitting yarn and two needle stitch yarn as a knitting yarn for constituting the wale formed in the tape main body most adjacent to the fixing warp knitting yarn. Because the tricot knitting yarn and the two needle stitch yarn have a function for forming wales and jointing those wales, the knitted fabric configuration is stabilized and the fastener elements are fixed. Therefore, by employing these knitting yarns together with the chain knitting yarn, not only the tightening force to the fastener element is intensified, but also the degree of the covering on the upper leg portion of the fastener element is also increased, and the configuration of the groove formed between adjoining wales can be obtained in a stable manner.

BEST MODE FOR CARRYING OUT THE INVENTION

Hereinafter, a typical embodiment of the present invention will be described specifically regarding expressed embodiments.

Figure 1:
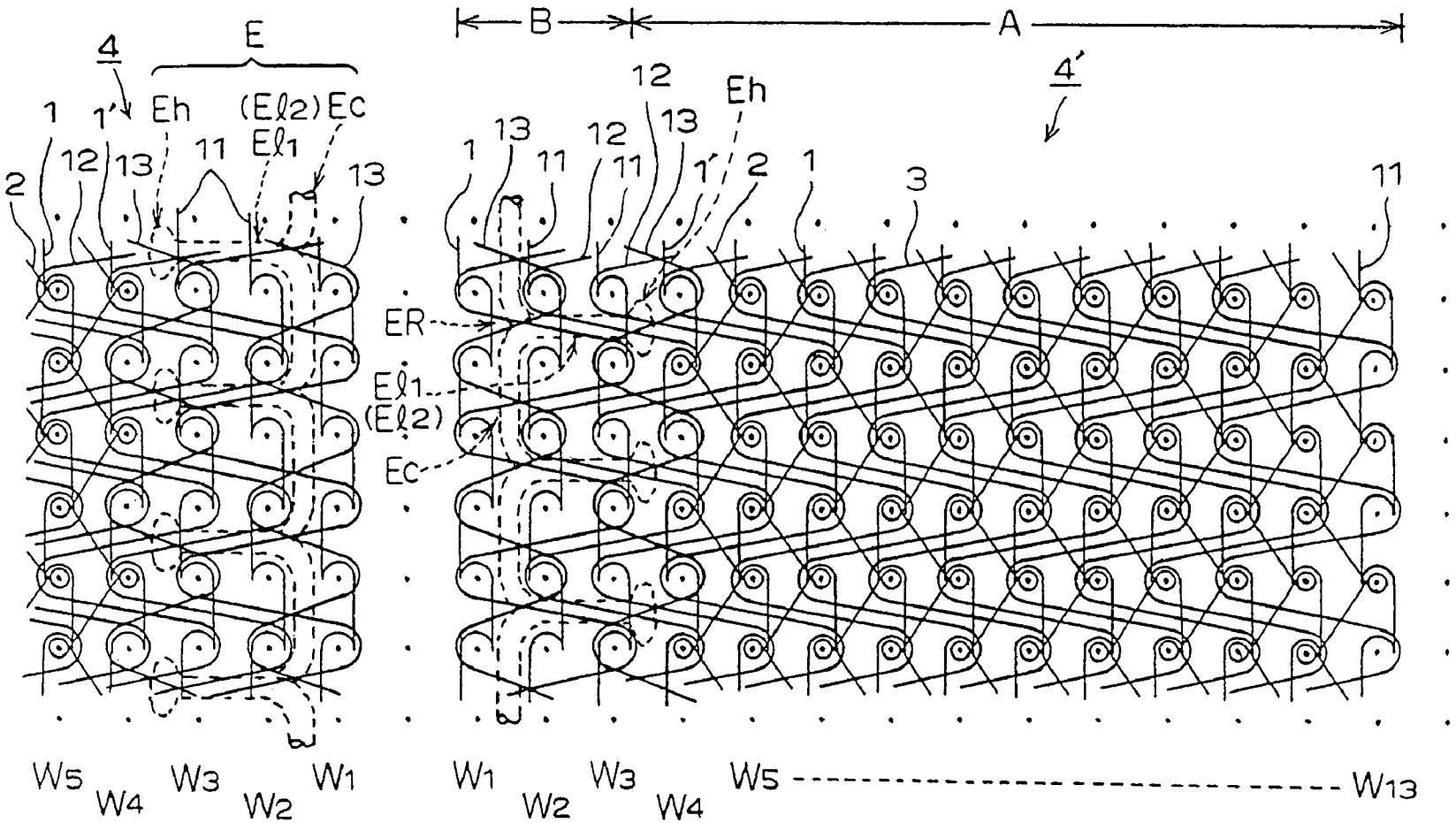
FIG. 1 is a knitted structure diagram showing a typical embodiment of the concealed type slide fastener of the present invention.
Figure 2:
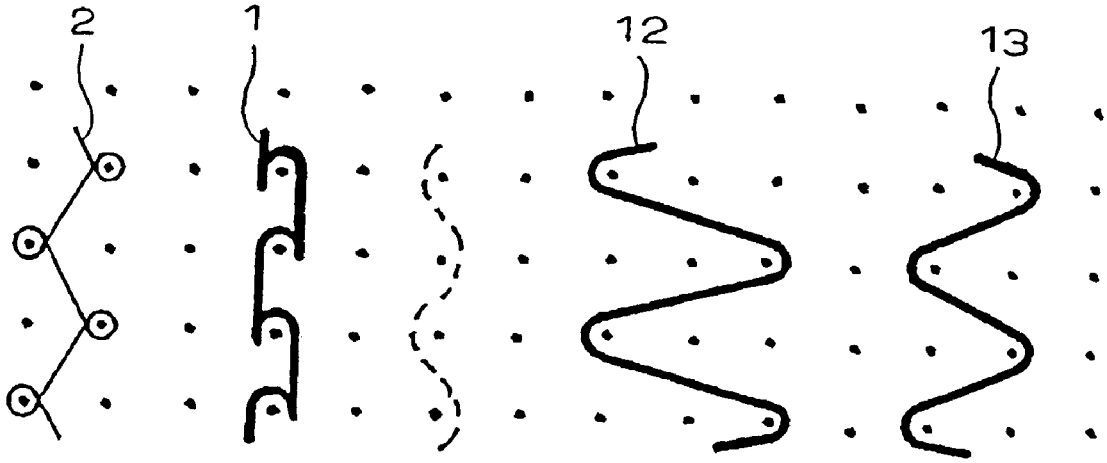
FIG. 2 is a structure diagram of each knitting yarn for use in the concealed type slide fastener.

FIG. 1 shows a knitted structure of the typical embodiment of a knitted concealed type slide fastener according to the present invention. FIG. 2 shows a structure diagram in the unit of knitting yarn for use in the embodiment, and FIGS. 3 and 4 show an attaching state of a continuous fastener element row, a bending state of a tape and a sewing position on an attaching object.

The knitted concealed type slide fastener of the invention is formed with a warp knitting machine such as Russel knitting machine having a needle bed. As shown in FIG. 2, a foundation structure of its tape main body A comprises a 1-0/0-1 chain knitting yarn 1, a 1-2/1-0 tricot knitting yarn 2 and a 0-0/3-3 weft in-laid yarn 3 inserted in a zigzag manner across three wales W of a fastener tape 4. Then, an element attaching portion B composed of three-row wales $W_1$ to $W_3$ on a side edge portion in the longitudinal direction of each of a pair of right and left fastener tapes 4, 4' excludes a 1-2/1-0 tricot knitting yarn, and comprises a 1-0/0-1 chain knitting yarn 11, a 0-0/3-3 weft in-laid yarn 12 inserted in a zigzag manner across the three wales $W_1$ to $W_3$ of the fastener tape 4 and two-row wales $W_4$, $W_5$ in the tape main body A adjacent to the wale $W_3$, and a 2-2/0-0 inverted weft in-laid yarn 13 inserted in a zigzag manner across the two wales $W_1$, $W_2$ and $W_3$, $W_4$ so as to intersect the weft in-laid yarn 12 not existing in the tape main body A.

Figure 3:
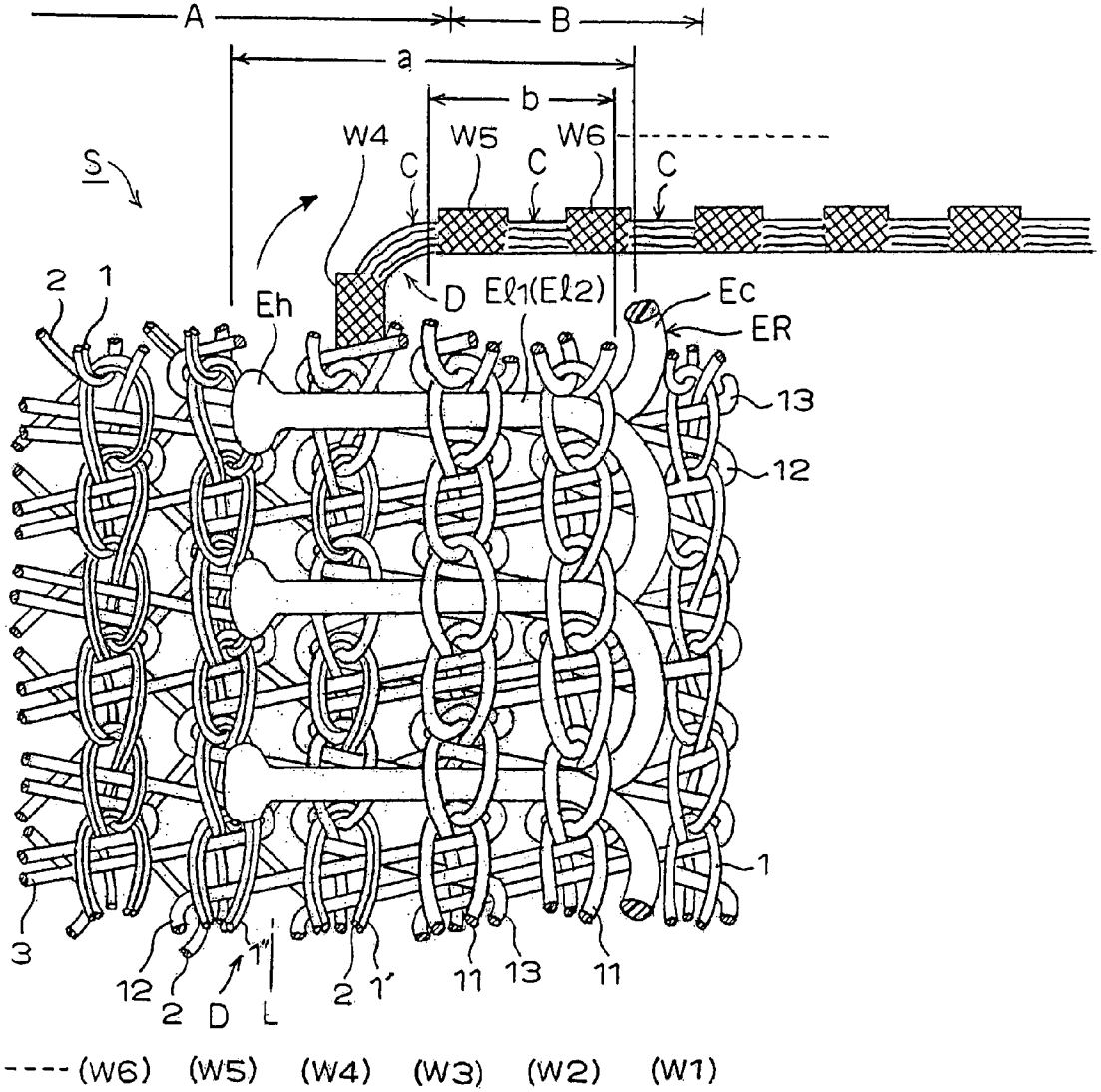
FIG. 3 is a major portion perspective view schematically showing an attaching state of a fastener element row in the concealed type slide fastener and a bending state of a fastener tape.
Figure 4:
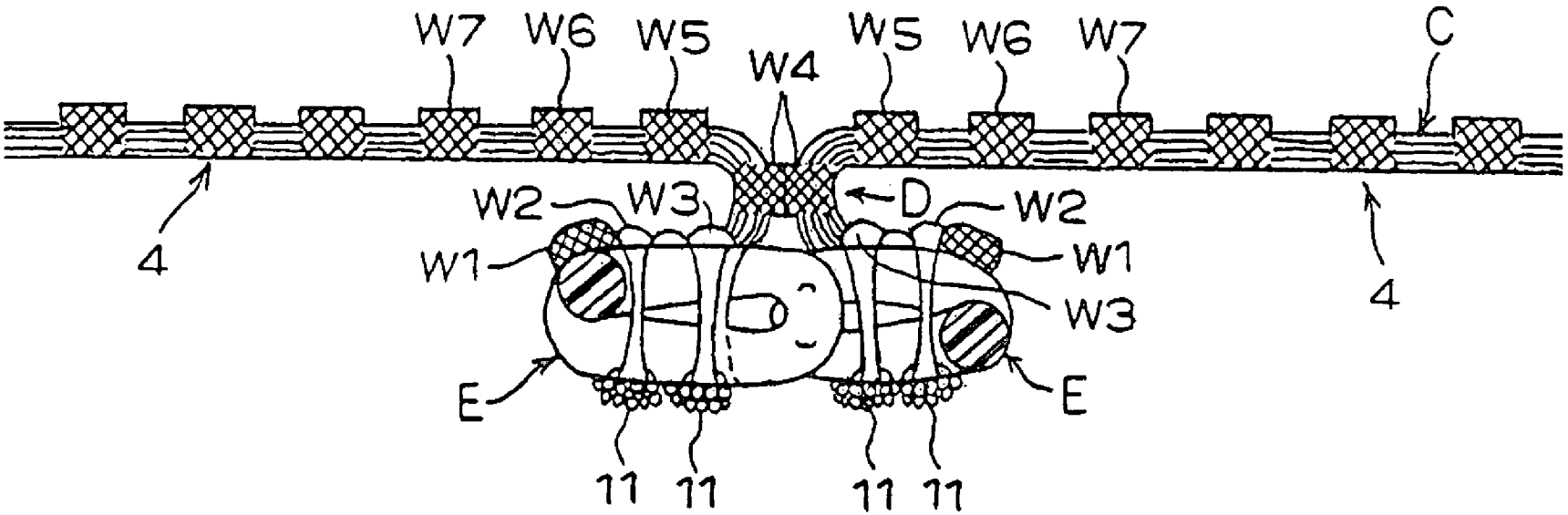
FIG. 4 is a lateral sectional view of major portions showing the attaching state of the fastener element row.

In the meantime, these knitting structures are not limited to the structures shown in FIGS. 1 to 3, and those knitting structures are allowed to be changed appropriately, for example, a warp in-laid yarn having a 0-0/1-1 structure may be knitted in a zigzag manner into the wale $W_2$ in the element attaching portion B of the fastener tape 4 and the needle loop of the fixing chain knitting yarn 11 constituting the $W_2$, or a 0-2/2-0 two needle stitch yarn may be knitted in. Alternatively, the knitting structure of the weft in-laid yarns 3 and 12 may be formed as 0-0/4-4 while the knitting structure of the inverted weft in-laid yarn 13 may be formed as 3-3/0-0. Further, with the knitting structure of the weft in-laid yarn 12 and inverted in-laid yarn in the element attaching portion B formed as 0-0/3-3 and 2-2/0-0 as shown in FIG. 1, the weft in-laid yarn in the tape main body A may be formed as 0-0/4-4.

On the other hand, a synthetic resin made monofilament 5 molded of nylon polyester or the like as a connecting portion Ec for connecting a coupling head Eh constituting a coil-like fastener element row ER with upper/lower leg portions $El_1$, $El_2$ stretches across two wales $W_2$, $W_3$ adjacent to the wale $W_1$ disposed at the outermost side in the element attaching portion B, with the coupling head Eh directed toward the tape main body A and the connecting portion Ec directed toward outside of the element attaching portion B. Then, it reciprocates laterally within the same course while skipping a single course C, with the upper/lower leg portions $El_1$, $El_2$ of each fastener element E pressed down with the needle loops of two 1-0/0-1 fixing chain knitting yarns 11, 11, in the two wales $W_2$, $W_3$ constituting the foundation structure of the element attaching portion B, so that it is knitted in continuously as the fastener column ER at the same time when the fastener tape is formed by knitting.

In a stringer S of this embodiment having such a knitting structure, as shown in FIG. 3, the fastener tape 4 is bent along a bending line L into a U shape with the fastener element row ER facing outside and then set with heat. That is, according to this embodiment, the fastener tape 4 is bent along a wale $W_4$ in the tape main body A adjacent to the wale $W_3$ for fixing elements nearest the tape main body of the element attaching portion B so as to form a bending portion D, and this is sewed to an attaching object along a groove C formed between the wale $W_4$ and wale $W_5$ in the tape main body A adjacent to the wale $W_4$ with a sewing thread. In FIG. 3, the respective knitting yarns 1 to 3 and 11 to 14 are assumed to be yarns having the same thickness and a single structure and expressed in states in which the stitch of a needle loop is loosened. Actually, the thickness and quantity of knitting yarns are selected appropriately considering the function as its knitted slide fastener, so that the stitches are tightened densely.

According to this embodiment, the fixing chain knitting yarns 11, 11 of the two wales $W_2$, $W_3$ disposed in the element attaching portion B are set thicker than all other knitting yarns 1 to 3, 12 and 13 constituting the fastener tape 4. The fixing chain knitting yarns 11, 11 are regardless of whether a multifilament yarn or twisted yarn. According to this embodiment, a twisted yarn composed of two multifilaments is used as a single fixing chain yarn 11, and the thickness of each multifilament yarn is set to 165 dTex while the total thickness of a single fixing chain knitting yarn 11 is set to 165×2 (330) dTex. The quantity of total filaments of the fixing chain knitting yarn 11 of this embodiment and the size of each yarn of its constituent filament is not different from conventionally.

Not only a required mounting strength to the fastener element E can be secured by using the fixing chain knitting yarn 11, but also by tightening the needle loop of the fixing chain knitting yarn 11 firmly across the upper leg portion $El_1$ of the fastener element E, the fixing chain knitting yarn 11 is flattened so that the top face of the upper leg portion $El_1$ is extended in the longitudinal direction to cover most of the upper leg portion $El_1$. As for the covering ratio at this time, if speaking of a portion exposed outside of the surface of the fastener element E covered with the fixing chain knitting yarns 11, 11, the exposed portion of each element B covered with each fixing chain knitting yarn 11, 11 in the fastener element row ER is located on the coupling head side. When it is assumed that a distance from the front end of each coupling head Eh to the inner face of the connecting portion Ec is (a) while the dimension of the fastener element E at the side of the leg portion E covered with the fixing chain yarns 11, 11 is (b), the value of (b/a) needs to be larger than 1/2 and 4/5 or less.

If the value of (b/a) is smaller than 1/2, the coupling portion of an element is easy to see through the gap even when the slide fastener attached on an attaching object is pulled in the direction of disengaging the elements along the fastener tape 4 by an ordinary force. If the value of (b/a) exceeds 4/5, the respective fixing chain knitting yarns 11, 11 cover part of the coupling head Eh, thereby preventing a smooth sliding operation of the slider.

On the other hand, a single multifilament yarn of the same thickness is used for knitting yarns (chain knitting yarn 1, tricot knitting yarn 2) of the most part (wales $W_5$, $W_6$, . . . $W_{n-1}$) constituting the tape main body A of this embodiment, and the thickness of each knitting yarn is set to 84 dTex, which is the smallest one as the constituent yarn of the fastener tape 4. The single fiber size in the unit of filament of each multifilament yarn constituting the chain knitting yarn 1 and tricot knitting yarn 2 which constitute the most part of the foundation structure is set as small as 0.5 to 1.5 dTex. The quantity of the constituent filaments of a single multifilament yarn used here is 72. On the other hand, a bulky finished yarn composed of multifilament is used as the weft in-laid yarn 3 which constitutes the foundation structure, and its thickness is 110 dTex, which is slightly larger than the chain knitting yarn 1 and the tricot knitting yarn 2. The quantity of the constituent filaments is 48, which is smaller than the quantity of the constituent filaments of other knitting yarns, whereby the single fiber size of each filament being increased. The chain knitting yarn constituting the wale $W_1$ disposed most outside of the element attaching portion B uses the same kind of the knitting yarn as the chain knitting yarn 1 of the tape main body A. Further, as the chain knitting yarn constituting the wale $W_n$ disposed most outside of the tape main body A, the same kind of knitting yarn as the fixing chain knitting yarn 11 is used to maintain the ear shape of its end portion and a strength.

However, because the wales formed in the most region which constitutes the tape main body A is composed of the chain knitting yarn 1, the tricot knitting yarn 2 and the weft in-laid yarn 3, the thickness of an entire yarn constituting each wale is 84×2+110 (=278) dTex. Because the groove between respective wales formed in this way depends on the fiber size of the weft in-laid yarn 3, the thickness thereof is about 110 dTex. The tape main body B obtained in this way is constituted of multiple filaments whose composition knitting yarns are smaller by about 1/4 than conventional one in terms of single fiber size, and particularly the weft in-laid yarn 3 is bulky finished yarn, so that extreme plasticity and softness feeling are secured.

In addition to the fixing chain yarn 11 of this embodiment, the most prominent feature exists in the groove structure formed between the wale $W_4$ in the tape main body A adjacent to the wale $W_3$ for fixing the elements nearest the tape main body of the element attaching portion B and the wale $W_5$ in the tape main body A adjacent to the wale $W_4$. As for the wale $W_4$ in the tape main body A adjacent to the wale $W_3$ for fixing the elements disposed nearest the tape main body of the element attaching portion B, when the fastener tape 4 is bent along the bending line L shown in FIG. 3, the wales $W_4$ of right and left stringers S make firm contact with each other in a butting state. If the right and left wales $W_4$, $W_4$ depart from each other, the coupling portion of the fastener element E existing on the rear side between the wales becomes easy to see from outside.

According to this embodiment, the thickness of the wale $W_4$ in a tape piercing direction is increased so as to keep the fitting state between the wales $W_4$ even if a strong force intending to release coupling of the right and left element rows ER is applied to the concealed type slide fastener. Thus, according to this embodiment, a thick yarn is employed for a knitting yarn for forming the wale $W_4$, and a knitting structure for tightening from the right and left to narrow the wale width is adopted.

According to this embodiment, the wale $W_4$ comprises four kinds of yarns including the 1-0/0-1 chain knitting yarn 1', the 1-2/1-0 tricot knitting yarn 2 which constitutes the foundation structure of the tape main body A, the 0-0/3-3 weft in-laid yarn 12, and the 2-2/0-0 inverted weft in-laid yarn 13 which is weft-inserted while intersecting the weft in-laid yarn 12. The chain knitting yarn 1' of this embodiment is composed of two multifilament yarns having a thickness of 84 dTex, its total thickness is 84×2 (168) dTex and the quantity of its filaments is 144. As compared with a conventional multifilament yarn of the same thickness (168 dTex, 36 filaments), it is understood that the single fiber size of the constituent filament is a very thin filament which is 1/4 the conventional one. By using the multifilament yarn composed of small size filaments as the chain knitting yarn 1' of the same thickness, stiffness at a boundary portion between the element attaching portion B and the adjoining tape main body A can be reduced to secure plasticity.

On the other hand, as the 0-0/3-3 weft in-laid yarn 12 and the 2-2/0-0 inverted weft in-laid yarn 13 to be weft-inserted while intersecting the 0-0/3-3 weft in-laid yarn 12, a highly shrinkable yarn having a thickness of 165 dTex, and a dry heat shrinking percentage of 8 to 20% is used. As these weft in-laid yarns 12, 13, the multifilament yarn using a filament having an ordinary single fiber size or an ordinary twisted yarn can be used. In the meantime, as the 1-2/1-0 tricot knitting yarn 2, the same kind of knitting yarn as the tricot knitting yarn 2 used in another tape main body is used.

According to this embodiment, as for the wale $W_5$ in the tape main body A adjacent to the wale $W_4$, a knitting yarn partially different from the knitting yarn (chain knitting yarn 1, tricot knitting yarn 2 and weft in-laid yarn 3) of the foundation structure constituting the other tape main body A is used. That is, as a chain knitting yarn 1" of this wale $W_5$, a multifilament yarn having a thickness of 110 dTex composed of 48 filaments is used. Although the thickness of the multifilament yarn or the single fiber size of the constituent filament are larger than those of the other chain knitting yarn in the tape main body A, but smaller than those of the fixing chain knitting yarn 11 and smaller than those of the chain knitting yarn 1' of the wale $W_4$ adjacent to the element attaching portion B. The other composition knitting yarns (tricot knitting yarn 2 and weft in-laid yarn 3) of this wale $W_5$ is equal to the corresponding knitting yarn of the wale $W_4$.

In the knitted concealed type slide fastener of this embodiment having such a structure, the multifilament yarn is employed for entirely the fastener tape 4 and particularly, the entire fastener tape 4 except the element attaching portion B and part of the weft in-laid yarns 12, 13 employs a multifilament yarn having a very small single fiber size of 0.5 to 1.5 dTex. As a consequence, there is given a slide fastener entirely having excellent plasticity and at the same time, excellent softness feeling.

Further, in the element attaching portion A, a thick multifilament is used as the element fixing chain knitting yarn 11, and the weft in-laid yarns 12 and the inverted weft in-laid yarn 13 having a large dry heat shrinking percentage are used. As a result, even if the core thread is removed, the upper/lower leg portions $El_1$, $El_2$ of each fastener element E can be tightened and fixed strongly, and the element fixing chain knitting yarn 11 can be tightened to the connecting portion Ec of the upper/lower leg portions $El_1$, $El_2$ of the fastener element E with the weft in-laid yarn 12 and inverted weft in-laid yarn 13 which shrink largely by dry heat setting. At the same time, the element fixing chain knitting yarn 11 composed of the multifilament is flattened to cover the top face of the upper leg portion $El_1$ largely. Therefore, even if a strong force is applied to the right and left stringers S after they are sewed on an attaching object, so that the coupling portion of the fastener element row ER is exposed outside, the element E is blocked from being seen from outside thereby securing the function of the concealed type slide fastener sufficiently.

Particularly according to this embodiment, a thicker multifilament yarn than the other chain knitting yarn 1 in the tape main body A is used as the composition knitting yarns of the wale $W_4$ in the tape main body A adjacent to the wale $W_3$ for fixing the elements on the side of the tape main body of the element attaching portion B and the wale $W_5$ in the tape main body A adjacent to the same wale $W_4$, particularly, its chain knitting yarns 1', 1". In addition, as the weft in-laid yarn on the side of the element attaching portion B folded back at the wales $W_4$, $W_5$, the weft in-laid yarns 12 and inverted in-laid yarn 13 having an excellent dry heat shrinking percentage to be inserted into the element fixing chain knitting yarn 11 are used at the same time. As a consequence, the weft in-laid yarn 12 and inverted in-laid yarn 13 shrink largely at the time of dry heat setting, so that both the wales $W_4$, $W_5$ are pulled to the side of the element attaching portion B. Particularly, the section of the wale $W_4$ is large and its thickness is increased, and therefore, even if a strong lateral force intending to release coupling of the continuous element rows ER is applied to the slide fastener attaching portion of an attaching object on which this concealed type slide fastener is sewed, the right and left wales $W_4$, $W_5$ fitted to each other at the bending portion D of the fastener tape 4 never depart to make the coupling portion of the elements E difficult to see.

The sectional shapes of the wale $W_4$ and the wale $W_5$ in the tape main body A adjacent to the same wale $W_4$ are formed larger than the other wales in the tape main body A, and at the same time, those wales $W_4$, $W_5$ are tightened with the weft in-laid yarn 12 and the inverted in-laid yarn 13. Accordingly, the thickness of each wale $W_4$, $W_5$ becomes larger than that of the other wales constituting the foundation structure. Thus, when the lateral force is applied, the loops of a sewing thread at a sewing portion is hooked by the wales $W_4$, $W_5$, so that it never moves further and the bending portion D of the fastener tape 4 is never expanded more, thereby the continuous element row ER being difficult to see from outside. Further, the configuration of a groove formed between the wales $W_4$ and $W_5$ can be expressed clearly, thereby facilitating the sewing operation on the attaching object. The groove width is preferred to be about 1 to 1.5 mm in order to prevent an opening from being generated in sewing with the attaching object.

Figure 5:
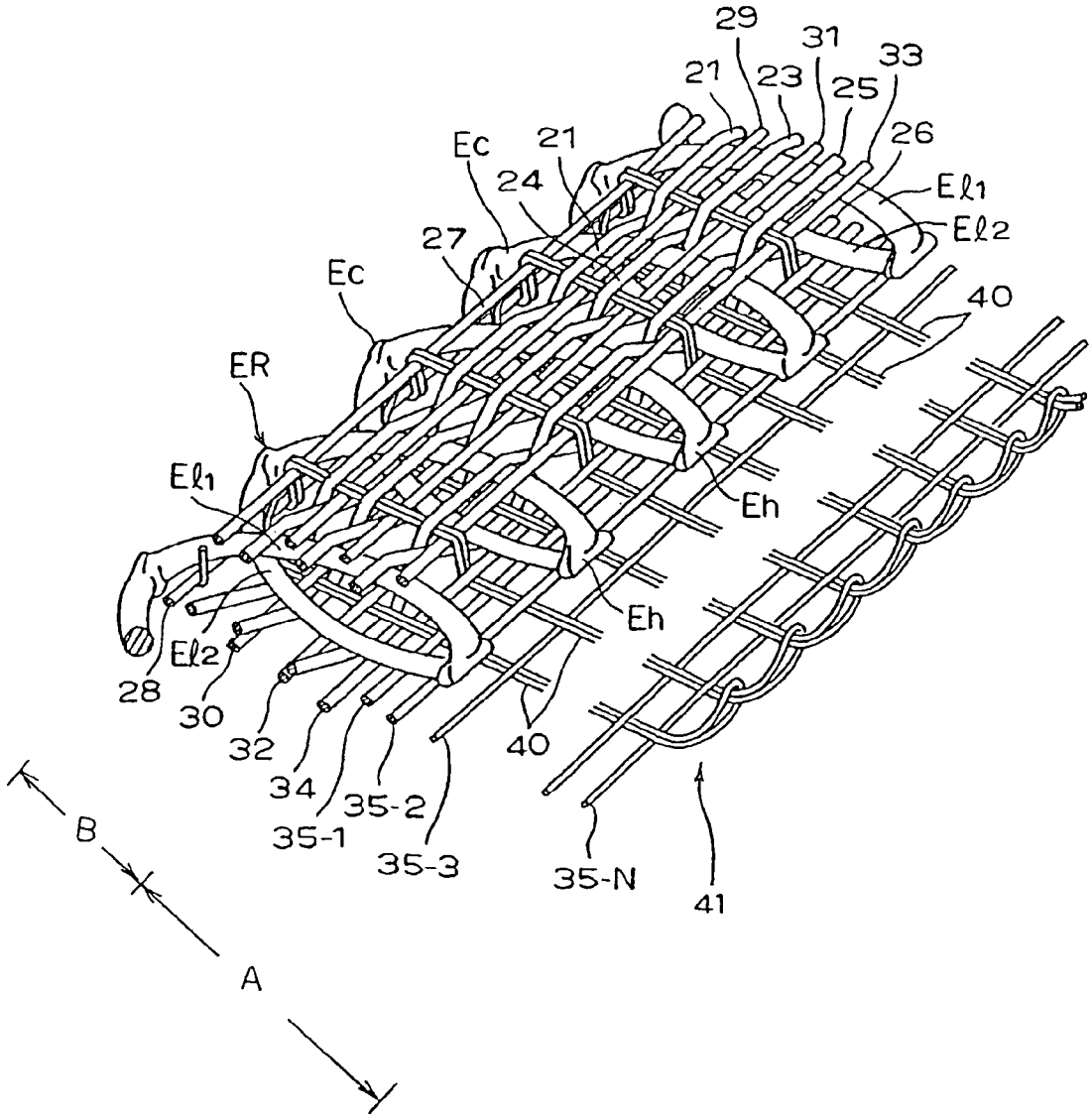
FIG. 5 is a perspective view of major portions schematically showing a typical embodiment of the woven concealed type slide fastener of the invention.
Figure 6:
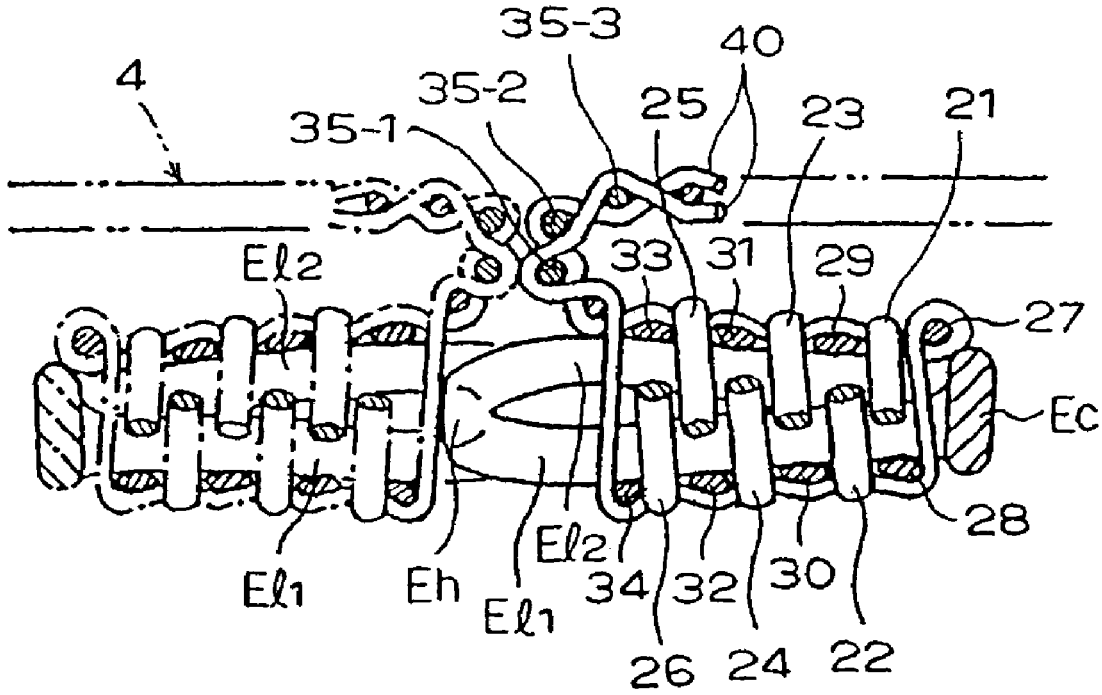
FIG. 6 is a major portion perspective view schematically showing the attaching state of the fastener element row and the bending state of the fastener tape in the concealed type slide fastener.

FIGS. 5 and 6 show a woven structure of the continuous fastener element row of the woven concealed type slide fastener according to a typical embodiment of the present invention and a bending condition of the concealed type slide fastener.

In the indicated woven concealed type slide fastener, a warp yarn group disposed in the element attaching portion B comprises: element fixing warp yarns 21 to 26 which run on the top face of the upper leg portion $El_1$ of each fastener element E and the bottom face of the adjacent lower leg portion $El_2$ alternately, the element fixing warp yarns 21 to 26 intersecting between adjoining elements E; and four pairs of upper/lower element fixing warp yarns 27 to 34, totaling eight, which are disposed among pairs of the element tightening warp yarns 21, 22; 23, 24; 25, 26 intersecting between the adjoining elements E and run on the top face of the upper leg portion $El_1$ of each fastener element E of the element row ER and the bottom face of the lower leg portion $El_2$ straightly without an intersection between the upper and lower ones, while the upper/lower leg portions $El_1$, $El_2$ of the element E are fixed from above and below with weft yarns 40 in pair, the weft yarns 40 being weft-inserted into between the respective elements E.

In the fastener element row ER, like the knitted concealed type slide fastener of the above-described embodiment, synthetic resin made monofilaments molded in the form of the coupling head Eh and the connecting portion Ec are woven successively at the same time when the fastener tape 4 is woven with its coupling head Eh directed toward the tape main body A, its connecting portion Ec disposed on the outer edge of the element attaching portion B and its upper/lower leg portions $El_1$, $El_2$ arranged in parallel vertically, so that they are attached on the element attaching portion B of the fastener tape 4. According to this embodiment, after the weft yarns 40 in pair are weft-inserted twice, each fastener element E of the fastener element row ER is weft-inserted.

The tape main body A of this embodiment is constituted of a plain weaving structure in which multiple warp yarns from a warp yarn indicated by reference numeral 35-1 in FIG. 1 to a warp yarn 35-N adjacent to a loop end entangling ear portion 41 of adjoining weft yarns 40 formed on a tape side end opposite to the element attaching portion B, intersect the weft yarn 40 successively. FIGS. 5 and 6 show an interval between the respective warp yarns 21 to 35-N for weaving the fastener tape, an interval between the weft yarns 40 and an interval between the respective fastener elements E larger than actually in order to clarify the weaving structure. In reality, however, the intervals between the warp yarns 21 to 35-N and the adjacent weft yarns 40 are much smaller, and the pitch between the respective fastener elements E is much shorter. In addition, the woven concealed type having the above-described structure can be manufactured according to a manufacturing method disclosed in, for example, the above-described patent document 4.

In the fastener stringer S having the above-mentioned structure, as shown in FIG. 6, the fastener tape 4 is bent along two warp yarns 35-1, 35-2 in the tape main body A disposed nearest the coupling head Eh of the element row ER and adjacent to the element fixing warp yarn 32 running on the bottom face of the lower leg portion $El_2$ of each element E with its fastener element row ER facing outside, and the bending condition is fixed by dry heat setting. If the coupling heads Eh disposed along opposing side edges of a pair of right and left fastener stringers S are engaged in the woven concealed type slide fastener obtained in this way, respective portions (bending portion D) of the two warp yarns 35-1, 35-2 in the tape main body A adjacent to the element fixing warp yarns 33, 34 disposed nearest the coupling head Eh of the element row ER are fitted to each other so as to keep the element coupling portion from being seen from outside.

Also in this woven concealed type slide fastener, a required mounting strength of the fastener element row ER is secured, and when this is attached on an attaching object by sewing, the coupling portion of the fastener element row ER is kept from being seen from outside even if a lateral force is applied to the right and left stringers S through the attaching object. Then, how to use the warp yarns 21 to 32 for fixing and tightening the element attaching portion B, the warp yarns 35-1, 35-2 in the tape main body A disposed at the bending portion D adjacent to the attaching portion B, and the weft yarn 40 will be described.

The basic technical idea of this embodiment is the same as the previously described embodiment shown in FIGS. 1 to 4. That is, preferably, as the warp yarns 21 to 32 for fixing and tightening the element attaching portion B, particularly, the tightening warp yarns 21 to 26, a thicker yarn than other yarns constituting the fastener tape 4 is employed, and at the same time, a multifilament composed of multiple filaments having a smaller filament size than ordinary one is employed. By employing such a thick multifilament, the fixing and tightening warp yarns 21 to 34 for fixing and tightening each element E are flattened on each element E, so that they cover the top face of the upper leg portion $El_1$ widely and can make the upper and lower leg portions $El_1$, $El_2$ fitted to each other. As a consequence, even if no core thread exists, the respective elements E never deflect in the tape width direction, so that the fastener element row ER can be attached on the element attaching portion B strongly.

Further, the multifilament yarn is used for the warp yarns 35-1, 35-2 disposed at the bending portion D in the tape main portion A adjacent to the element attaching portion B. Although the thickness of these warp yarns 35-1, 35-2 is smaller than that of the fixing/tightening warp yarns 21 to 34, it is set larger than the other warp yarns 35-3 to 35-N constituting the foundation structure. Moreover, each filament constituting the warp yarns 35-1, 35-2 disposed at the bending portion D and extremely fine filament of each of the warp yarns 35-3 to 35-N constituting the foundation structure, whose single fiber size is in a range of 0.5 to 1.5 dTex like the previously described embodiment, are used. Here, if the density of the warp yarns is set small, the respective warp yarns 35-1, 35-2 are tightened by the weft yarn 40, so that they are not flattened and the thickness in a tape piercing direction is increased. As a consequence, when the fastener elements E of the right and left stringers S are engaged, the right and left warp yarns 35-1, 35-2 at the bending portion D are fitted to each other firmly. Consequently, even if a lateral force is applied to the right and left stringers S through an attaching object, the warp yarns 35-1, 35-2 hardly depart from each other, thereby keeping the coupling portion of the fastener element row ER from being seen from outside.

To further secure these functions, preferably, by adopting a yarn having a high dry heat shrinking percentage for at least part of the weft yarn 40, such high shrinkage at the time of dry heating is used to squeeze the tightening warp yarns 21 to 26 in a direction that they come to make firm contact, and at the same time, the fixing warp yarns 27 to 34 are disposed vertically, and further, the warp yarns 35-1, 35-2 disposed at the bending portion D are squeezed. However, because it is difficult to change the kind of the weft yarn in the tape width direction because of the property of its manufacturing method, for example, it is permissible to employ a yarn having a high dry heat shrink characteristic for the weft yarn 40 and allow it to shrink in the tape width direction or use a weft yarn having a high dry heat shrink percentage and a weft yarn having a low dry heat shrink percentage dispersedly in the tape longitudinal direction. If an expandable yarn subjected to wooly treatment is used as the yarn having a low dry heat shrinking percentage when such weft yarns having a different shrinking percentage are used, even the yarn having a low dry heat shrinking percentage can follow up the heat contraction behavior of the yarn having a high dry heat shrink percentage. Additionally, a slide fastener entirely having a plasticity and an excellent softness feeling can be obtained.

The invention claimed is:

1. A knitted/woven concealed type slide fastener in which a continuous fastener element row comprised of a synthetic resin monofilament is knitted or woven into a fastener element attaching portion of a knitted/woven fastener tape having a warp knitting structure or a weaving structure at the same time when the fastener tape is knitted or woven, the knitted/woven fastener tape comprising a tape main body and the fastener element attaching portion, with each coupling head of the continuous fastener element row directed toward the fastener tape main body, the knitted/woven concealed type slide fastener comprising:

multiple fixing yarns which are knitted or woven into the fastener element attaching portion and which fix each element of the continuous fastener element row onto the fastener element attaching portion, wherein an exposed portion of each element of the fastener element row covered with respective fixing yarns is located on a side of the coupling head, and when it is assumed that a distance from a front end of each coupling head to an inside face of a connecting portion is (a) while a dimension of each element in a direction of a leg portion thereof covered with the fixing yarns is (b), a value of (b/a) is larger than 1/2 and 4/5 or less, and a total thickness of each of the multiple fixing yarns for covering a surface of an upper leg portion of each element is 1.5 to 5 times thicker than a thickness of other constituent yarns of the fastener tape.

2. The knitted/woven concealed type slide fastener according to claim 1, wherein one or more of warp yarns at a bending portion of the fastener main body adjacent to a coupling head row of the fastener element row is comprised of multifilament, and a single fiber size of a constituent filament of the warp yarn is set to 0.5 to 1.5 dTex.

3. The knitted/woven concealed type slide fastener according to claim 2, wherein a total thickness of each of the warp yarn at the bending portion of the fastener tape main body adjacent to the coupling head row of the fastener element row is set larger than a thickness of other warp knitting yarns or warp weaving yarns forming a foundation structure of the fastener tape.

4. The knitted/woven concealed type slide fastener according to claim 3, wherein a unit yarn of the warp yarns at the bending portion is comprised of two or more doubled yarns.

5. The knitted/woven concealed type slide fastener according to any one of claims 1 and 2-4, wherein at least a part of weft yarns of the element attaching portion of the fastener tape and the tape main body adjacent to the element attaching portion have a dry heat shrinking percentage higher by 8 to 20% than that of other constituent yarns of the fastener tape.

6. The knitted/woven concealed type slide fastener according to claim 3, wherein all other constituent yarns of the fastener tape except the fixing warp yarn and the weft yarn are comprised of multiple filament yarns, and a single fiber size of each constituent filament is 0.5 to 1.5 dTex.

7. The knitted/woven concealed type slide fastener according to claim 6, wherein a single fiber size of each constituent filament of the weft yarn which is part of the constituent yarns of the tape main body is 1.5 to 4.0 dTex.

8. The knitted/woven concealed type slide fastener according to any one of claims 1 and 2, wherein the fastener tape is comprised of a warp knitting structure, the fixing warp yarn is comprised of a warp knitting yarn, and a total thickness of the warp knitting yarn adjacent to a wale proximate to the tape main body is set larger than that of other composition knitting yarns of a foundation structure except the fixing warp knitting yarn.

9. The knitted/woven concealed type slide fastener according to claim 8, wherein the knitting yarns of a wale knitted in the tape main body most adjacent to the fixing warp knitting yarn comprise two or more kinds of warp knitting yarns and two kinds of weft in-laid yarns which are weft-inserted and folded back to right and left direction with respect to a course direction in the wale, and at least the weft in-laid yarns in the right and left direction have a dry heat shrinking percentage higher by 8 to 20% than that of other composition knitting yarns of the wale.

10. The knitted/woven concealed type slide fastener according to claim 7, wherein the fixing warp knitting yarn is comprised of a chain knitting yarn, and a needle loop thereof strides over a top face of an upper leg portion of the fastener element while a sinker loop thereof is connected to the foundation structure.

11. The knitted/woven concealed type slide fastener according to claim 9, wherein the knitting yarns of the wale knitted in the tape main body most adjacent to the fixing warp knitting yarn are comprised of a chain knitting yarn and a tricot knitting yarn or two needle stitch yarn.

12. The knitted/woven concealed type slide fastener according to claim 8, wherein the fixing warp knitting yarn is comprised of a chain knitting yarn, and a needle loop thereof strides over a top face of an upper leg portion of the fastener element while a sinker loop thereof is connected to the foundation structure.

13. The knitted/woven concealed type slide fastener according to claim 10, wherein the knitting yarns of the wale knitted in the tape main body most adjacent to the fixing warp knitting yarn are comprised of a chain knitting yarn and a tricot knitting yarn or two needle stitch yarn.

14. The knitted/woven concealed type slide fastener according to claim 12, wherein the knitting yarns of the wale knitted in the tape main body most adjacent to the fixing warp knitting yarn are comprised of a chain knitting yarn and a tricot knitting yarn or two needle stitch yarn.

* * * * *